US006145857A

United States Patent [19]

Bernstein

[11] Patent Number: 6,145,857

[45] Date of Patent: Nov. 14, 2000

[54] SKATEBOARD ACCESSORY

[76] Inventor: William L. Bernstein, 19730 Shadow Glen Cir., Northridge, Calif. 91326

[21] Appl. No.: 09/336,035

[22] Filed: Jun. 18, 1999

Related U.S. Application Data

[60] Provisional application No. 60/089,917, Jun. 19, 1998.

[51] Int. Cl.[7] ..... A63C 17/00

[52] U.S. Cl. ..... 280/87.042; 280/809; 280/11.2; 280/11.27

[58] Field of Search ..... 280/11.19, 11.27, 280/11.28, 87.041, 87.042, 11.2, 809

[56] References Cited

U.S. PATENT DOCUMENTS

| | | |
|---|---|---|
| D. 244,706 | 6/1977 | Vela . |
| 3,235,282 | 2/1966 | Bostick . |
| 3,990,713 | 11/1976 | Hokanson . |
| 4,076,265 | 2/1978 | Eash II . |
| 4,084,831 | 4/1978 | Akonteh et al. . |
| 4,095,817 | 6/1978 | Cohen . |
| 4,127,282 | 11/1978 | Gorlach et al. . |
| 4,140,326 | 2/1979 | Huber . |
| 4,152,001 | 5/1979 | Christianson . |
| 4,155,565 | 5/1979 | De Caussin et al. . |
| 4,165,089 | 8/1979 | Urdea et al. . |
| 4,181,316 | 1/1980 | Brand et al. . |
| 4,183,547 | 1/1980 | Cohen et al. . |
| 4,184,693 | 1/1980 | Whitmarsh . |
| 4,195,857 | 4/1980 | Hechinger . |
| 4,196,916 | 4/1980 | Schorr . |
| 4,251,087 | 2/1981 | Hansen . |
| 4,323,261 | 4/1982 | Samuelson . |
| 4,398,735 | 8/1983 | Evans et al. . |
| 4,592,567 | 6/1986 | Sartor . |
| 4,930,794 | 6/1990 | Chan . |
| 5,002,294 | 3/1991 | Franz . |
| 5,052,702 | 10/1991 | Chan . |
| 5,114,166 | 5/1992 | McCosker . |
| 5,224,719 | 7/1993 | Goodspeed . |
| 5,263,725 | 11/1993 | Gesmer et al. . |
| 5,590,908 | 1/1997 | Carr . |

*Primary Examiner*—Richard M. Camby
*Attorney, Agent, or Firm*—Oppenheimer Wolff & Donnelly LLP

[57] ABSTRACT

An accessory for a skateboard which comprises a panel-like element with through apertures for receiving fasteners to secure the accessory to selected portions of the skateboard. The accessory has dimensions of or between one-third the width to the full width of a skateboard, and a length permitting it to be mounted between a truck and the skateboard at one end thereof to the rear truck of the skateboard, and which has a free end located subadjacent to the upturned kicktail of the skateboard. When executing a jump known as an "Ollie," the user steps down on the kicktail and thereby compresses the accessory which, upon release, adds energy to the jump. The accessory also acts as a buffer between the kicktail and the ground, protecting the kicktail from wear.

6 Claims, 2 Drawing Sheets

SKATEBOARD ACCESSORY

This application claims benefit of Provisional application Ser. No. 60/089,917 filed Jun. 19, 1998.

BACKGROUND OF THE INVENTION

This invention relates to an accessory for skateboards that enhances jumps known as "Ollies."

The Ollie is a basic skateboard trick achieved by the skateboard user stepping hard with his back foot down on the skateboard kicktail, quickly forcing the kicktail into the ground. The force of the kicktail striking the ground bounces the skateboard into the air. The user jumps vertically so as to rise with the board. The user then levels the opposite end of the skateboard off by sliding his front foot toward the front of the skateboard.

It is desirable for skateboard users to increase the height achieved when executing an Ollie as more complex maneuvers based on the Ollie require at least five inches (5") of lift.

SUMMARY OF THE INVENTION

The invention contemplates the enhancement of the basic skateboard maneuver known as an Ollie by employing, in a preferred embodiment of the invention, a leaf spring-like element with through apertures on one end for receiving fasteners, screws and the like whereby the accessory can be attached to or removed from selected portions of the skateboard. The accessory has dimensions of or between one-third the width to the full width of a skateboard, and a length permitting it to be mounted between a truck and the skateboard at one end thereof to the rear truck of the skateboard, and which has a free end located subadjacent to the upturned kicktail of the skateboard. The aforementioned through apertures are oval in shape stretching longitudinally, allowing the free end of the accessory to be adjusted to extend out in equal length to the end of the kicktail.

In accordance with a broader aspect of the invention, the accessory may be implemented by other spring-inclusive arrangements, such as are noted hereinbelow.

When executing a jump known as an "Ollie," the user steps down on the kicktail and thereby compresses the accessory which, upon release, adds energy to the jump. The accessory also acts as a buffer between the kicktail and the ground, protecting the kicktail from wear.

The accessory is preferably formed of a suitable flexible and wear-resistant material, preferably a plastic having a quick and total return to its undistorted state (memory) and a very low coefficient of friction such as a polycarbonate.

DESCRIPTION OF THE PREFERRED EMBODIMENTS

Figure 1:
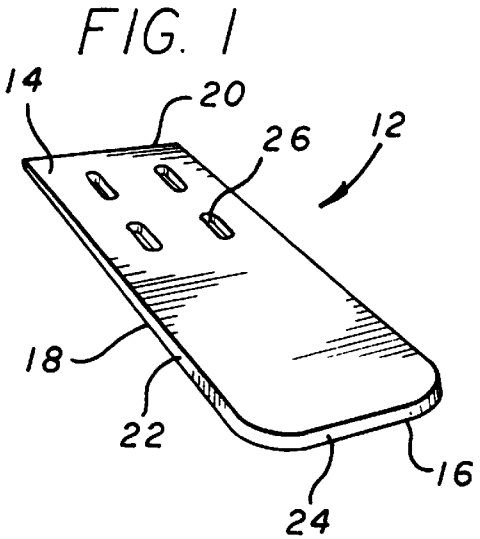
FIG. 1 is a perspective view of an accessory panel for use with skateboards.

Referring now to FIG. 1, the accessory panel of the invention in the preferred embodiment is shown as a panel member 12 having a squared edge 14 and a rounded trailing edge 16. The panel is defined by opposite, planar faces 18 and 20 with upright or generally perpendicular sidewalls, such as 22 and rear wall 24. The panel is provided with attachment means 26 in the form of a plurality of elongated through apertures of ¾ inch in length to receive fastening means such as screws, bolts, and the like.

Figure 2:
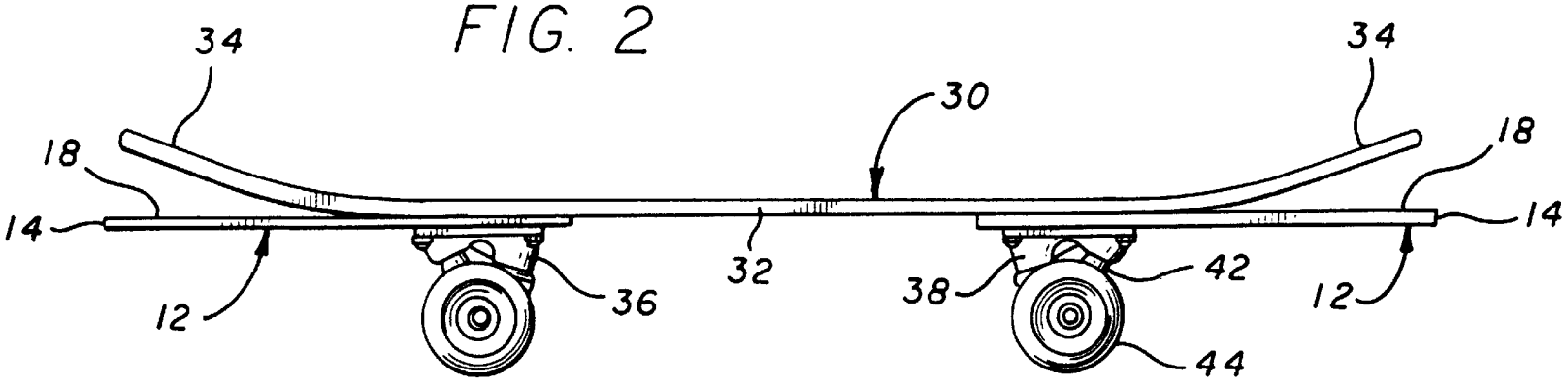
FIG. 2 is a side view of a skateboard assembly illustrating the invention, and including the panel of FIG. 1.
Figure 3:
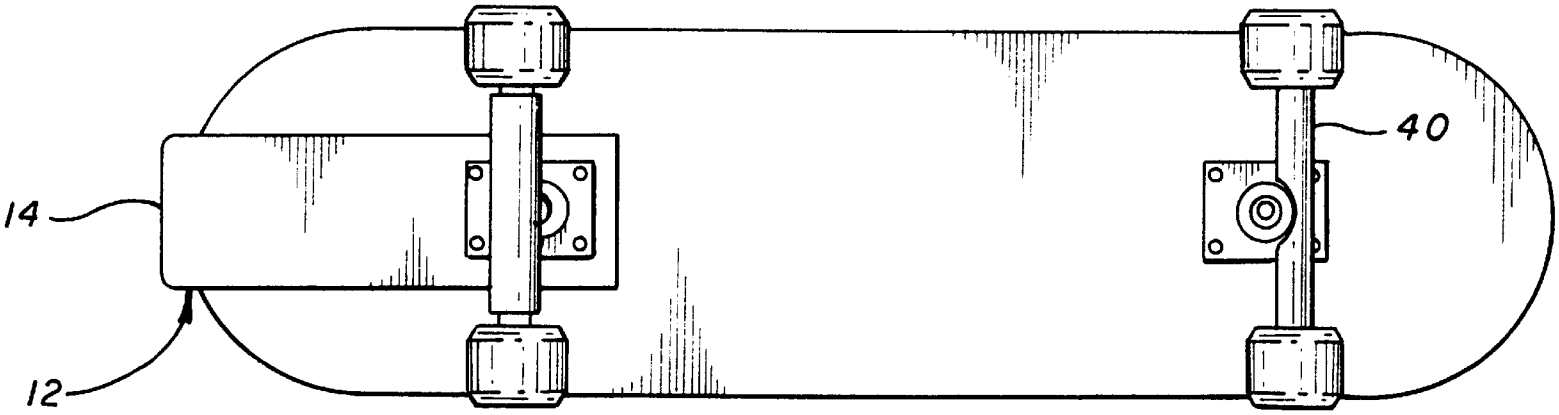
FIG. 3 is a bottom view of the skateboard assembly of FIG. 2.

Referring now to FIG. 2 and FIG. 3, there is illustrated a skateboard 30 having a platform 32 with double kicktail ends 34. The skateboard is provided with conventional fore and aft trucks 36 and 38 which carry an axle 40 rotatably mounted therein in suitable bearings. The axles are supported by the trucks with provision for tilting movement of the axle about a mounting axis 42. The skateboard wheels 44 are carried on the distal portions of the truck axles 40.

Figure 4:
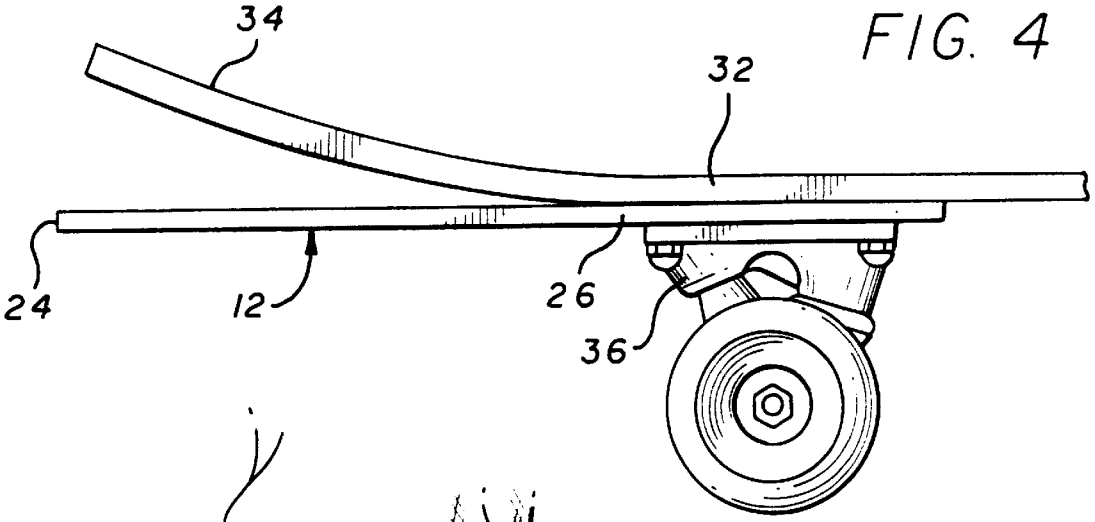
FIG. 4 is an enlarged side view of the rear of the skateboard assembly.

Referring now to FIG. 4, the accessory panel 12 of the invention is employed as a leaf-like spring member by mounting the panel 12 with its rounded leading edge 24 subadjacent the rear edge of the kicktail 34. The elongated through apertures 26 are used to adjust the extended length of the panel where it is fastened between the truck 36 and the skateboard platform 32, so that the outer end of the panel is substantially coextensive with the rear end of the skateboard platform. The panel 12 has a width approximating one-third the width of the skateboard platform 32. In this position, the accessory panel 12 serves as a leaf spring-like member that catapults the skateboard and user into the air when executing an Ollie.

Figure 5:
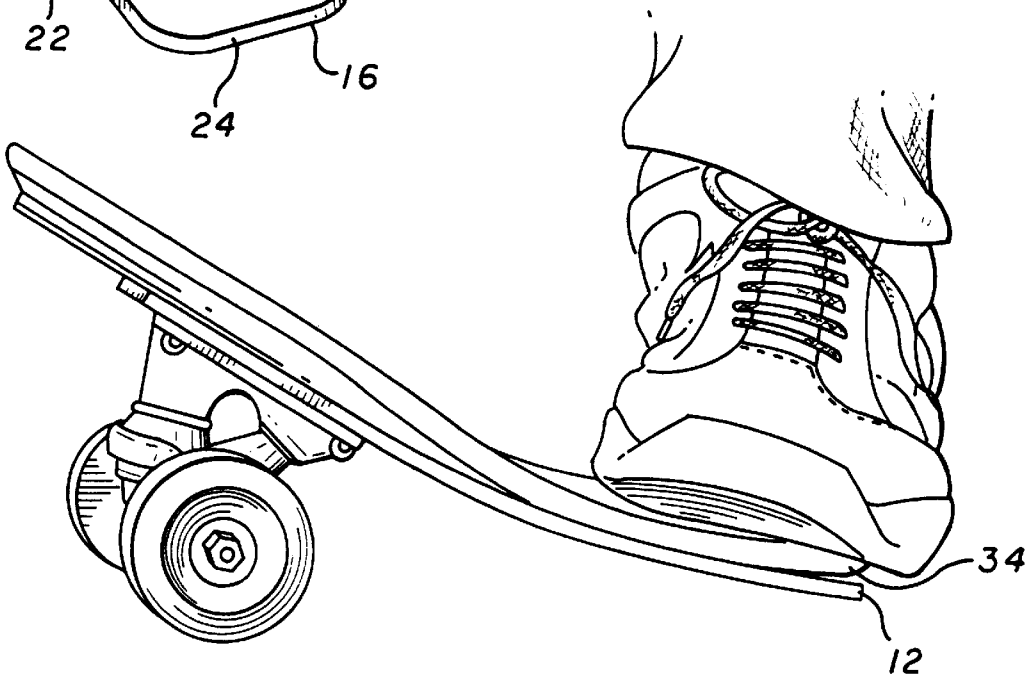
FIG. 5 shows the skateboard assembly with the accessory panel fully compressed and deflected.

Referring now to FIG. 5, the panel accessory 12 is illustrated in its compressed position. The compressed position is achieved by applying weight to the skateboard kicktail 34. In one successful implementation, approximately 18 or 20 pounds was effective in compressing the panel. Greater or less strength and flexibility panels may be used, depending on the weight and needs of the user. The accessory panel 12 may be formed of polycarbonate having high flexural strength. Although other various plastics may be used, Lexan/Polycarbonate is preferred. Lexan/Polycarbonate may be purchased from most plastic fabricators.

Concerning the dimensions of the panel, in one successful assembly, the panel was approximately 10¼ inches long, 3½ inches wide, and between ⅛- and 3/16-inch thick. The foregoing dimensions were for a Lexan/Polycarbonate panel. With different materials, it would be expected that different dimensions would be employed to obtain the desired spring action.

The invention has been described and illustrated with the presently-preferred embodiment. It is not intended that the invention be unduly limited by this description of the illustrated and preferred embodiment as other embodiments, such as a pivoted member with a pair of coil springs or another spring-like device would be used to achieve the same results. Instead, it is intended that the invention be defined by the means, and their obvious equivalents, set forth in the following claims.

What is claimed is:

1. A skateboard assembly comprising:

a skateboard platform having at least one upturned end;

front and rear trucks, each having two wheels, secured to said skateboard platform toward and spaced away from the ends of said skateboard platform; and spring arrangements including a flat flexible panel secured to said skateboard platform between one of said trucks and the skateboard platform, said panel extending outward from at least one upturned end of said skateboard, below said upturned end, and extending for substantially the length of said upturned end, for compression as said skateboard is tilted toward the ground;

whereby airborne skateboard maneuvers such as jumps or Ollies are enhanced by the release of energy from the compressed spring arrangements in the course of such maneuvers.

2. A skateboard assembly as defined in claim 1 wherein said panel has mounting holes which are elongated to permit adjustment of the rearward extent of the panel.

3. A skateboard assembly as defined in claim 1 wherein said panel is formed of high strength plastic.

4. A skateboard assembly comprising:

a skateboard platform having at least one upturned end;

front and rear trucks, each having two wheels, secured to said skateboard platform toward and spaced away from the ends of said skateboard platform; and spring arrangements extending outward from at least one upturned end of said skateboard, below said upturned end, and extending for substantially the length of said upturned end, for compression as said skateboard is tilted toward the ground;

whereby airborne skateboard maneuvers such as jumps or Ollies are enhanced by the release of energy from the compressed spring arrangements in the course of such maneuvers.

5. A skateboard assembly as defined in claim 4 wherein said panel has mounting holes which are elongated to permit adjustment of the rearward extent of the panel.

6. A skateboard assembly as defined in claim 4 wherein said panel is formed of high strength plastic.

* * * * *